US007086547B2

(12) United States Patent
Hanamoto

(10) Patent No.: US 7,086,547 B2
(45) Date of Patent: Aug. 8, 2006

(54) TRAVELLING WORKING MACHINE

(75) Inventor: Takahiro Hanamoto, Akashi (JP)

(73) Assignee: Kobelco Cranes Co., Ltd., Tokyo (JP)

( * ) Notice: Subject to any disclaimer, the term of this patent is extended or adjusted under 35 U.S.C. 154(b) by 0 days.

(21) Appl. No.: 10/668,174

(22) Filed: Sep. 24, 2003

(65) Prior Publication Data

US 2004/0060885 A1 Apr. 1, 2004

(30) Foreign Application Priority Data

Sep. 30, 2002 (JP) ..... 2002-285726

(51) Int. Cl.
*B66C 23/26* (2006.01)

(52) U.S. Cl. ..... 212/175; 212/232

(58) Field of Classification Search ..... 212/175, 212/232

See application file for complete search history.

(56) References Cited

U.S. PATENT DOCUMENTS

| | | | | | |
|---|---|---|---|---|---|
| 1,886,032 | A | * | 11/1932 | Lotte | 414/690 |
| 2,144,760 | A | * | 1/1939 | Harnischfeger | 212/253 |
| 2,186,372 | A | * | 1/1940 | Elgh | 212/298 |
| 2,440,199 | A | * | 4/1948 | Huston | 212/293 |
| 2,458,271 | A | * | 1/1949 | Huston | 212/172 |
| 2,605,002 | A | * | 7/1952 | Graves | 212/202 |
| 4,398,698 | A | * | 8/1983 | Crawford et al. | 254/291 |
| 4,469,186 | A | * | 9/1984 | Goodwine | 180/9.1 |
| 5,240,129 | A | * | 8/1993 | Schrick et al. | 212/175 |
| 5,353,940 | A | * | 10/1994 | Pech et al. | 212/180 |
| 5,598,935 | A | * | 2/1997 | Harrison et al. | 212/197 |
| 6,152,425 | A | * | 11/2000 | Boyer | 254/323 |

FOREIGN PATENT DOCUMENTS

| | | | |
|---|---|---|---|
| JP | 8-169689 | * | 7/1996 |
| JP | 10-167673 | * | 6/1998 |
| JP | 10-310371 | * | 11/1998 |
| JP | 2000-289984 | * | 10/2000 |
| JP | 2001-316080 | | 11/2001 |

* cited by examiner

*Primary Examiner*—Thomas J Brahan
(74) *Attorney, Agent, or Firm*—Oblon, Spivak, McClelland, Maier & Neustadt, P.C.

(57) ABSTRACT

This invention provides with a travelling working machine comprising an upper rotating body with a rotating frame and winches, a pair of right and left boom support frames formed in the rotating frame, and axial portions of the winches mounted inside rear portions of the boom support frames, characterized in that the boom support frames have openings formed by being cut out along small-diameter portions of the winches than maximum-diameter portions thereof, thereby capable of providing with the travelling working machine having the rotating frame in such a manner that the strength of the frame can be enhanced and a load bearing force can be strengthened highly without enlarging a rear swing radius of the upper rotating body.

5 Claims, 5 Drawing Sheets

TRAVELLING WORKING MACHINE

BACKGROUND OF THE INVENTION

1. Field of the Invention

This invention relates to a travelling working machine with winches.

2. Description of the Related Art

FIG. 8 shows a telescopic boom type crane. An upper rotating body 52 is mounted rotatably on a lower travelling body 51 with crawlers 50. A telescopic boom is mounted on the upper rotating body 52 so as to be capable of rising and lowering. The reference numeral 54 is a cylinder for rising and lowering the boom 53.

A main winding rope 55*a* taken from a main winch 55 hangs up a main lifting hook 55*b* and an auxiliary rope 56*a* taken from an auxiliary winch 56 hangs up an auxiliary hook 56*b*, respectively.

As overhang of the boom in transport condition is too large, it is required to dispose the boom 53 and a boom supporting frame 52*a* as rearward as possible. In order to improve a workability or working efficiency at a limited space, it is required to make a rotating rear radius R (a distance from a rotating center to a rear end of the upper rotating body) of a crane like this as small as possible. Furthermore, a regulated transport condition limits a transverse width of the upper rotating body. As a result, there is not enough space on it to dispose the winches.

For saving the space, Japanese Patent Application Publication No. Hei 2001-316080 discloses a structure that, at a rearward portion (rear frame) of a boom supporting frame, winches are mounted in such a manner that two of them are disposed at left and right sides respectively of a lower portion of the frame and the other one is disposed at an upper portion thereof.

When the winches are disposed densely like this and a counterweight is mounted on a bracket at a rear frame with a sufficient strength has to be prepared so as to support load of the winches and the counterweight and so on.

In the meantime, when a winch with a transverse width which is longer than a width of a rear frame is used, it is necessary to form openings of the rear frame which have enough space for a flange, for example, as a maximum diameter-portion of the winch to pass through. Accordingly, the greater capacity of winding up the winch mounted on the rear frame has, the larger diameter the flange has. As a result, as the openings have to be larger in diameter according to the larger diameter, it is difficult to obtain a required strength of the rear frame.

SUMMARY OF THE INVENTION

The present invention has an object to provide a travelling working machine with a rotating frame structure capable of withstanding a support of winches and a counterweight with a rear end swing radius smaller.

A travelling working machine of the present invention comprises a lower traveling body, an upper rotating body mounted rotatably on the lower traveling body, wherein the upper rotating body has a rotating frame and winches, a boom mounted on the upper rotating body so as to be capable of rising and lowering, and a pair of right and left boom support frames formed in the rotating frame to pivotally support both right and left sides of a rear end portion of the boom, wherein axial portions of the winches, including maximum-diameter portions of the winches, is mounted inside rear portions of the boom support frames and the boom support frames have openings formed by being cut out along smaller-diameter portions of the winches than the maximum-diameter portions.

The maximum-diameter portion of each of the winches indicates a portion with a maximum diameter among a flange of the winch drum, a brake device mounted on a side of the winch drum, and a portion of a decelerator mounted inside the rotating frame out of an outer periphery surface of the decelerator. In other words, it means a portion with a maximum outer diameter among mechanical elements (devices) disposed in a radial direction of the winch, i.e., in a direction of a diameter of the winch from a rotating axis of the winch drum.

According to the present invention, as the boom support frames such as rear frames have openings in such a manner that the smaller-diameter portions of the winches pass through the openings, the strength of the rear frames can be enhanced and thereby a load bearing or supporting force can be strengthened highly.

BRIEF DESCRIPTION OF THE DRAWINGS

FIGS. 1A and 1B are a plan view thereof and a side view thereof respectively;

DESCRIPTION OF THE PREFERRED EMBODIMENTS

Preferred embodiments of the present invention are described in detail below with reference to the attached FIGS. 1–7. The present invention is not restricted only to such embodiments.

Figure 1A:
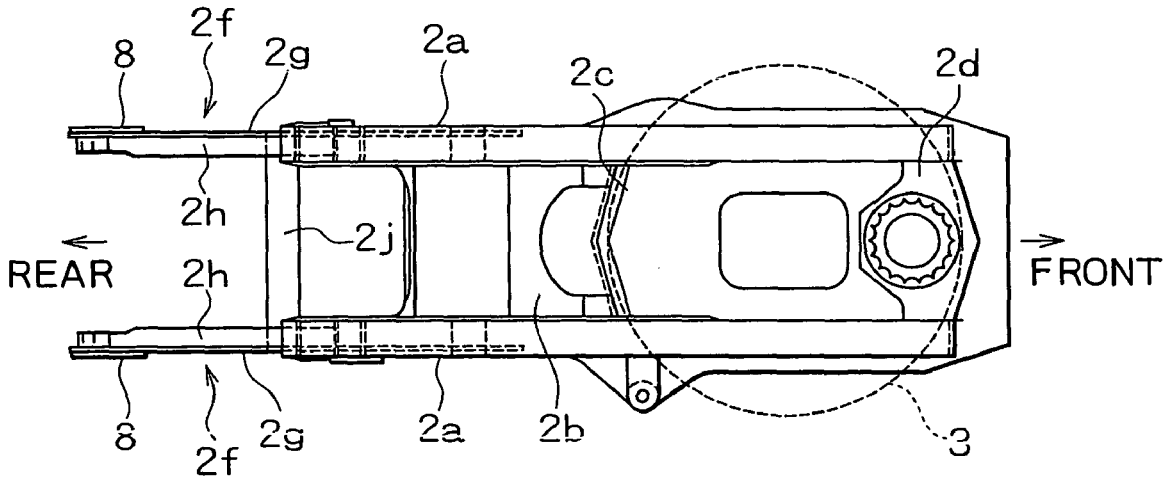
FIGS. 1A and 1B are views of a rotating frame of a telescopic boom type crane according to an embodiment of the present invention.
Figure 1B:
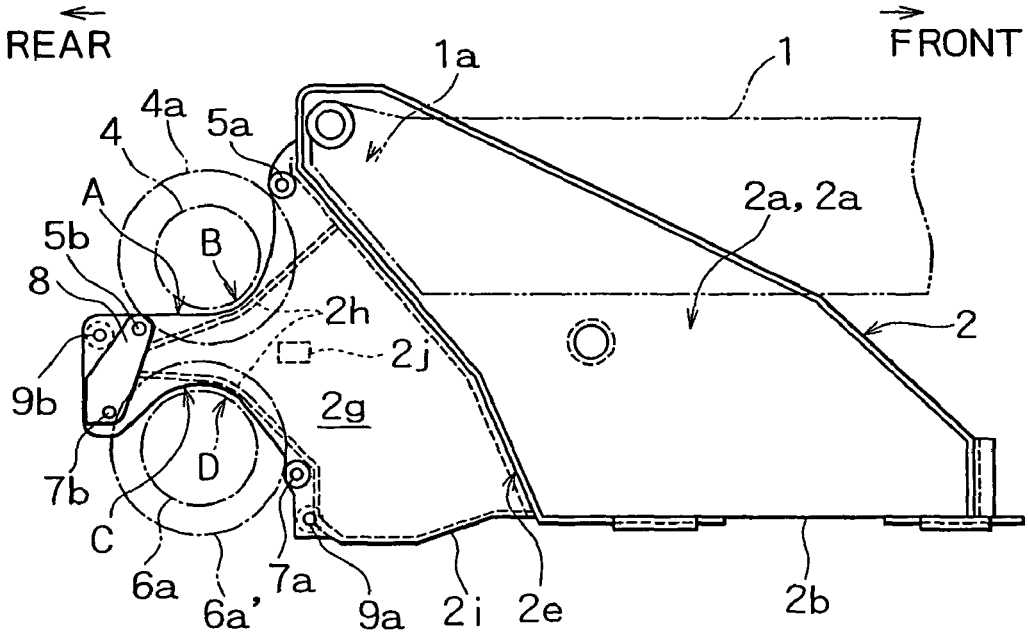

FIGS. 1A and 1B are a plan view and a side view, respectively, showing a rotating frame of a telescopic boom type crane in a traveling working machine according to an embodiment of the present invention.

With reference to FIG. 1B, a description will now be given of portions related to the present invention. The reference numeral 1 denotes a telescopic boom and the numeral 2 denotes a rotating frame to which a base end portion 1*a* of the telescopic boom 1 is attached. Devices are mounted on the rotating frame 2 to constitute an upper rotating body. The upper rotating body is mounted rotatably on a lower traveling body which is provided with a moving means such as a crawler.

The rotating frame 2 comprises a pair of boom support frames 2*a*, 2*a* bottom plate 2*b*, and a pair of front and rear reinforcing frames 2*c*, 2*d*.

The pair of boom support frames 2*a*, 2*a* (hereinafter may be referred to simply as support frames) are spacedly disposed right and left in parallel with each other in such a manner as sandwich the boom end portion 1*a* therebetween. As shown in the figure, the frames 2*a*, 2*a* are each in a generally triangular shape in side view in which the rear side is inclined upward. The frames 2*a*, 2*a* may hereinafter be referred to as "A" frames.

The bottom plate 2*b* is provided between lower surface sides of the support frames 2*a*, 2*a*.

The pair of front and rear reinforcing frames 2*c*, 2*d* are mounted bridgewise between both support frames 2*a*, 2*a* at front portions of the support frames.

A rotating motor mounting seat 3 is provided on the reinforcing frame 2*d*, and a pinion gear of a rotating motor (not shown) and a ring gear provided on a lower traveling body side are in mesh with each other. A swing bearing (not shown) is mounted on lower surface sides of the reinforcing frames 2*c* and 2*d* through the bottom plate 2*b*. A load on the upper rotating body side is transmitted through the swing bearing to the lower traveling body side.

A pair of rear frames 2*g*, 2*g* which are each constituted by a plate, are formed integrally and backwards at a rear end portion 2*e* of the boom support frame 2*a*.

The rear frames 2*g*, 2*g* are formed convexly backward and are reinforced by a reinforcing frame 2*h*.

Bosses 5*a* and 5*b* for mounting a main winch 4 are provided at upper front and rear positions of the rear frames 2*g*, 2*g*. Likewise, bosses 7*a* and 7*b* for mounting an auxiliary winch 6 are provided at lower front and rear positions of the rear frames 2*g*, 2*g*. Further, in each of the rear frames 2*g*, bosses 9*a* and 9*b* for the connection of a detachable frame 10 to be described later are disposed respectively near the lower side of the boss 7*a* and near the rear side of the boss 5*b*.

Cutout portions A are formed in upper edges of the rear frames 2*g*, 2*g* and the main winch 4 is disposed therein. The cutout portions A are formed outside in the vehicle width direction of flanges 4*a* of the main winch 4 and arcuately along a part of an outer periphery surface B of a decelerator in the main winch 4.

Further, cutout portions C are formed in lower edges of the rear frames 2*g*, 2*g* and the auxiliary winch 6 is disposed in the cutout portions C. The cutout portions C are formed outside in the vehicle width direction of flanges (large-diameter portions) 6*a*' of the auxiliary winch 6 (outside in an axial direction of a drum of the winch) and arcuately along a part of an outer periphery surface (a small-diameter portion) D of a decelerator in the auxiliary winch 6.

The numeral 2*i* denotes a reinforcing rib which reinforces a lower surface portion of each of the rear frames 2*g*, 2*g* and numeral 2*j* denotes an intermediate beam which connects intermediate portions of the rear frames 2*g*, 2*g* in the vehicle width direction. Numeral 8 denotes a reinforcing plate which straddles the bosses 5*b* and 7*b*. Thus, a winch is mounted on a rear portion of the rotating frame 2.

Figure 2B:
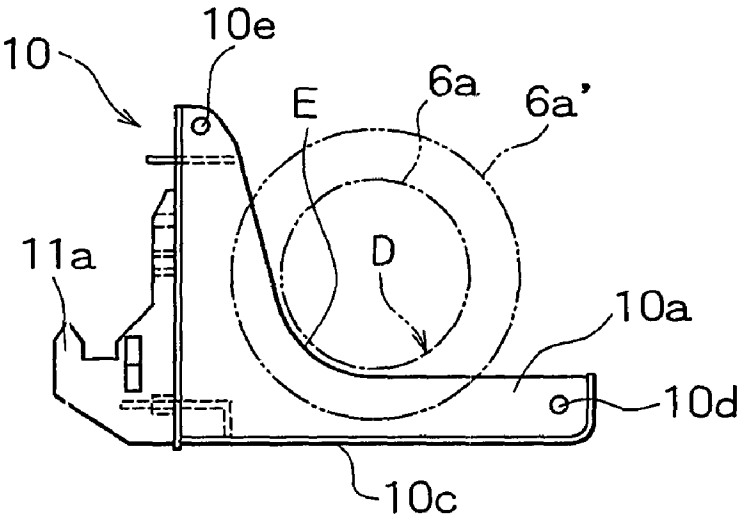
FIGS. 2A–2C are views of a structure of a detachable frame connected to a rear frame of FIGS. 1A and 1B, and FIGS. 2A–2C are a rear view thereof, a side view thereof, and a bottom plan view thereof respectively.
Figure 2C:
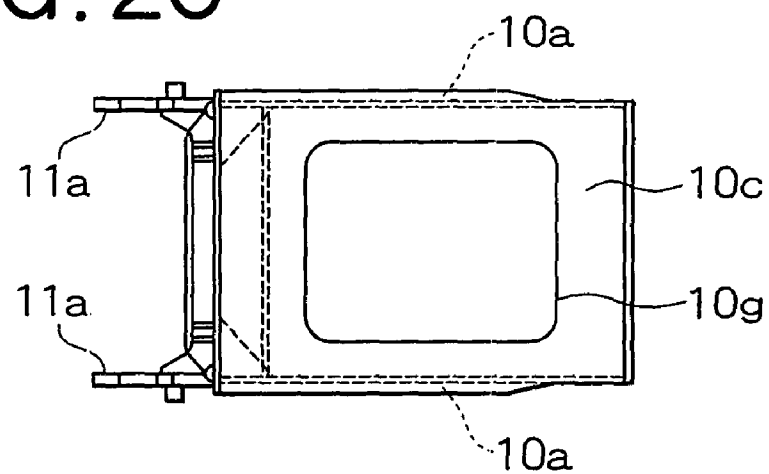
Figure 2A:
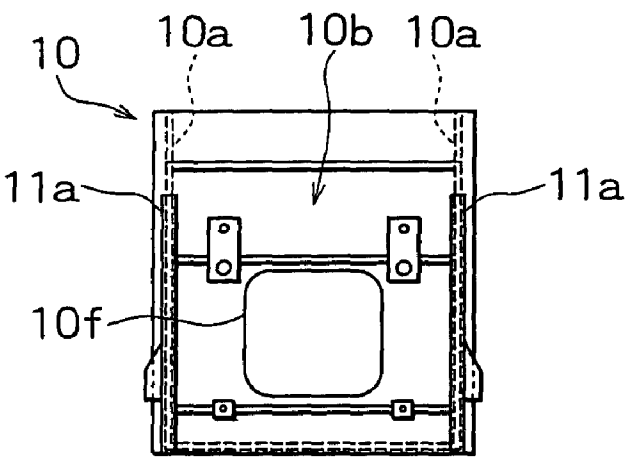

FIGS. 2A to 2C illustrate the construction of a detachable frame which is connected detachably to lower portions of rear ends of the rear frames 2*g*, 2*g* of which FIG. 2A is a rear view thereof, FIG. 2B is a side view thereof, and FIG. 2C is a bottom view thereof. The rear frames 2*g*, 2*g* and the detachable frame 10 constitute rear portions of the boom support frames.

In those figures, the detachable frame 10 comprises a pair of side plates 10*a*, 10*a* each formed in L shape and disposed in the longitudinal direction, a rear plate 10*b*, 10*b* connected so as to close a rear side of the side plates 10*a*, 10*a* and a bottom plate 10*c* connected so as to close a bottom side of the side plates 10*a*. Further, counterweight mounting portions 11*a*, 11*a* for mounting a counterweight (hereinafter may be referred to as "CW") (not shown) are fixed to rear ends of the side plates 10*a*.

Cutout portions E are formed in upper edges of both side plates 10*a* so as to confront the cutout portions C (see FIG. 1B) of the rear frames 2*g* when the detachable frame 10 is connected to the rear frames 2*g*. The cutout portions E are formed arcuately so as to extend partially along the outer periphery surface D (a small-diameter portion) of the decelerator of the auxiliary winch 6.

That is, when the cutout portions E of the detachable frame 10 and the cutout portions C of the rear frame 2*g* are positioned so as to sandwich the decelerator outer periphery surface D of the auxiliary winch 6 from both above and below, they define generally circular winch openings S (see FIG. 3) which will be described later.

A mounting hole 10*d* formed in each side plate 10*a* of the detachable frame 10 corresponds to the boss 9*a* shown in FIG. 1B and a mounting hole 10*e* formed in each side plate 10*a* corresponds to the boss 9*b* shown in the same figure.

Numeral 10*f* denotes an opening for winch inspection which opening is formed in the rear plate 10*b*, and numeral 10*g* denotes an opening for winch inspection which opening is formed in the bottom plate 10*c*.

Figure 3:
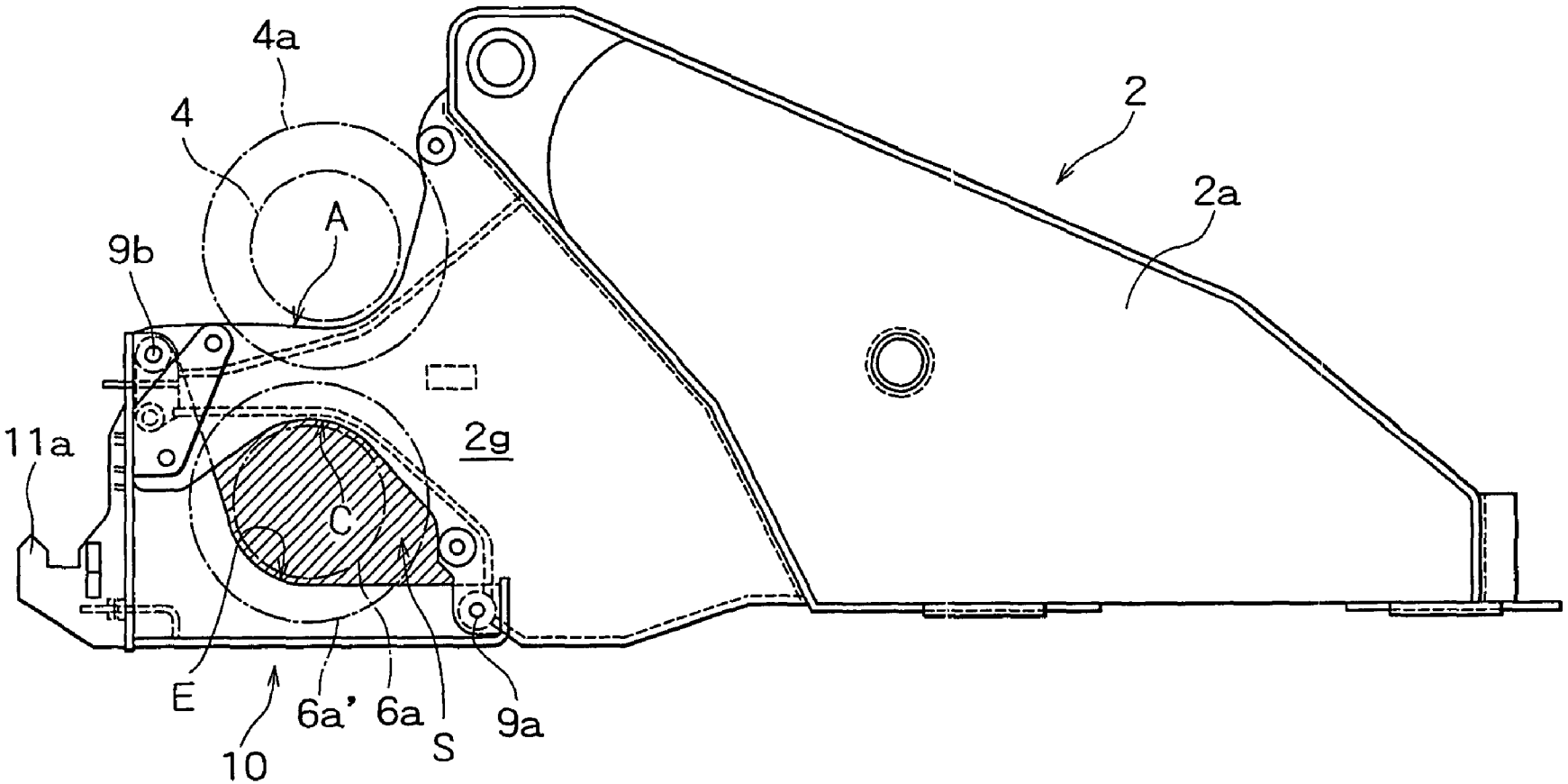
FIG. 3 is a side view of the rotating frame in a state of connecting the rear frame with the detachable frame.

FIG. 3 shows a connected state of the detachable frame 10 to the rear frames 2*g*.

In the following description, the same components as in FIGS. 1A, 1B and FIGS. 2A to 2C will be identified by the same reference numerals and explanations thereof will be omitted.

In FIG. 3, the mounting holes 10*d* and 10*e* of the detachable frame 10 are made corresponding to the bosses 9*a* and 9*b*, respectively, then in this state a connecting pin is inserted in each set of mounting hole and boss, whereby the detachable frame is connected to and rendered integral with the rear frames 2*g*.

With CW not mounted, if brackets for mounting the main and auxiliary winches are strengthened so as to withstand the weights and tensions of the winches, it is possible to support the rotating frame even in the absence of rear frames 2*g*. On the other hand, with CW mounted, the provision of rear frames 2*g* permits a construction which can support the rotating frame 2 while reducing the weight of the rotating frame. Thus, the rear frames 2*g* are superior in point of function thereof.

It is preferable that each rear frame 2*g* be made equal in width to each boom support frame 2*a* at a rear portion of the frame 2*a*. This is because of being efficient in ensuring high strength and rigidity. There also may be adopted a construction wherein each rear frame 2*g* be made smaller in width than each support frame 2*a* and extend backward from an inside position, or conversely each rear frame 2*g* may be widened outwards. In this case, it is preferable to adopt a construction wherein the connection of each rear frame 2*g* with the support frame 2*a* is formed in a tapered shape.

In this embodiment, the rear and lower ends of the rear frames 2*g* are integrally connected with the detachable frame 10. Besides, the detachable frame 10 extends along a part of a portion D (see FIG. 1B), i.e., along the outer periphery surface of the decelerator of the auxiliary winch 6, which portion D lies outside in the vehicle width direction of a winch drum 6*a* of the auxiliary winch 6 and has a diameter smaller than the winch flange diameter. The rear frames 2*g* and the detachable frame 10 thus rendered integral with each other as one unit can form winch openings S which permit passage therethrough of only the decelerator portion of the auxiliary winch 6. As a result, the strength of the rear frames 2*g* is enhanced and it is possible to strengthen the load bearing force.

Figure 4:
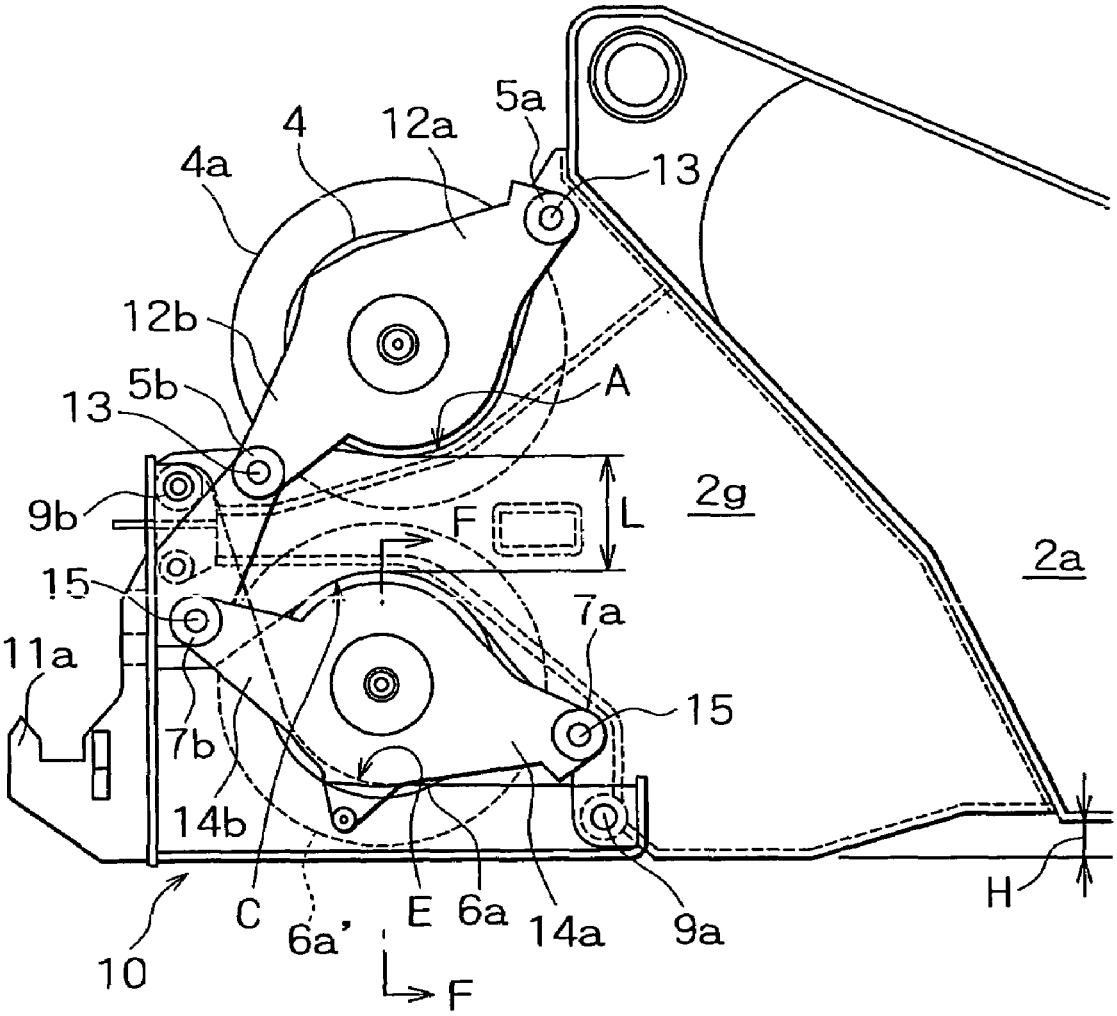
FIG. 4 is a side view of the rotating frame in a state of mounting a main winch and an auxiliary winch.

FIG. 4 shows a state in which the main winch 4 and the auxiliary winch 6 are mounted to the rear frames 2*g* thus enhanced in strength.

On each of both sides of the flanges 4*a* of the main winch 4, there are provided mounting brackets 12*a* and 12*b* in diametrically opposite directions. One of the brackets 12 and 12*b* is connected to the boss 5*a* of each of the rear frames 2*g* through a connecting pin 13, while the other bracket is connected the boss 5*b* through a connecting pin 13.

In this state, each cutout portion A passes the smaller-diameter portion than the flange diameter outside the associated flange 4*a*, ensuring a sufficient distance L between it and the underlying cutout portion C.

Also as to the auxiliary winch 6, like the main winch 4, there are provided mounting brackets 14*a* and 14*b*. One of the brackets 14*a* and 14*b* is connected to the boss 7*a* of each of the rear frames 2*g* through a connecting pin 15, while the other bracket is connected to the boss 7*b* through a connecting pin 15.

Accordingly, as noted above, the auxiliary winch 6 is disposed in a sandwiched state between the cutout portions C of the rear frames 2*g* and the cutout portions E of the detachable frame 10.

The rear frames 2*g* are extended with a difference in height, H, relative to the boom support frames 2*a*, whereby the longitudinal length of each rear frame 2*g* can be enlarged. As a result, the main winch 4 and the auxiliary winch 6 can be disposed in two vertical stages without any forcibleness.

Figure 5:
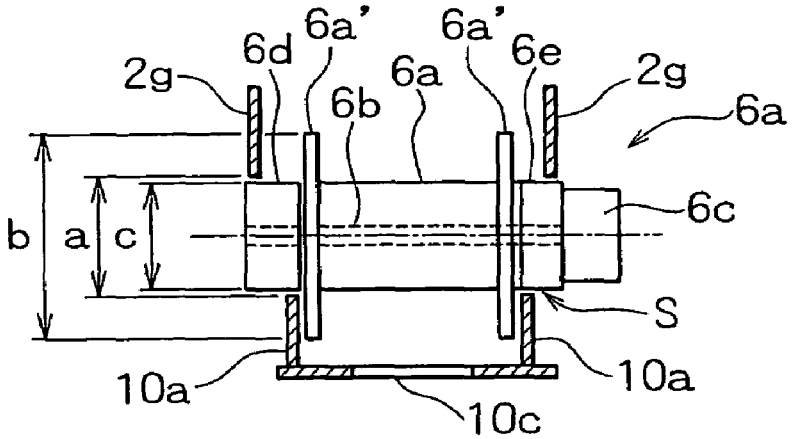
FIG. 5 is an explanatory view showing an arrangement of the detachable frame and the rear frame to a winch.

FIG. 5 is a view as seen in the arrowed direction F—F in FIG. 4, showing a mounted state of the auxiliary winch 6 schematically.

A winch generally comprises a winch drum, a decelerator, a hydraulic motor, a clutch, and a brake device, which are generally unitized. On the other hand, the rear frames which support the winch are usually provided in a shorter width than the overall length of a rotary shaft of the winch in order to attain the reduction of weight and in order to dispose the rear frames in proximity to the winch drum to bear the load on the winch drum positively and efficiently.

In FIG. 5, the auxiliary winch 6 incorporates a planetary reduction mechanism and a multiple disk type wet brake device. The auxiliary winch 6 comprises a winch drum 6*a*, a drum shaft 6*b*, a hydraulic motor 6*c*, clutch device 6*d*, and a reduction mechanism 6*e*.

The winch drum 6*a* has flanges 6*a*' as largest diameter portions in its axial direction. The drum shaft 6*b* is disposed along the axis of the drum 6*a*. The hydraulic motor 6*c* causes the drum shaft 6*b* to rotate. The clutch device 6*d* makes switching between transmission and non-transmission of an output of the hydraulic motor 6*c* with respect to the drum shaft. The reduction mechanism 6*e* decelerates the output of the motor 6*c* and transmits the decelerated output to the winch drum 6*a*.

End portions of the rear frames 2*g* are positioned outside the flanges (large-diameter portions) 6*a*' of the winch drum 6*a* in its axial direction and in opposition to upper outer periphery surfaces of the clutch device 6*d* and the reduction mechanism 6*e*. The drum 6*a* is mounted inside between the frames 2*g*. The clutch device 6*d* and the reduction mechanism 6*e* which form smaller-diameter portions than the flanges 6*a*' are positioned on a radially central side with respect to the outside diameter of the flanges 6*a'*.

On the other hand, the side plates 10*a* of the detachable frame 10 are positioned outside the drum 6*a* and in opposition to lower outer periphery surfaces (small-diameter portions) of the clutch device 6*d* and the reduction mechanisms 6*e*.

More specifically, as shown in FIG. 5, given that a minimum size of the winch opening S is "a" and the diameters of the large- and small-diameter portions of the winch are b and c, respectively, their values are set so as to satisfy the relation of $b>a\geqq c$.

According to this construction, the strength of each rear frame 2*g* can be enhanced in comparison with the conventional construction in which a larger opening than the flange diameter of the drum 6*a* is formed in each rear frame.

Thus, in the rotating frame 2 are formed openings S running along a smaller-diameter portion than the maximum-diameter portion of the winch mounted inside the frame.

By "mounting inside" is meant a state in which a part of the winch is disposed substantially within the width of the pair of right and left boom support frames 2*a* which are main strength enhancing members of the rotating frame 2. In the embodiment illustrated in FIGS. 1A and 1B, a winch drum is positioned between the rear frames 2*g* of the rotating frame 2 and the motor driver and the decelerator are disposed at outwardly projecting positions of the boom. The winch drum constitutes an axial part of the winch.

In the above embodiment, reference has been made to a constructional example in which the decelerator 6*e* is mounted within the range of the winch drum 6*a* provided a part thereof projects axially from the winch drum 6*a* and constitutes a small-diameter portion), and an output shaft of the hydraulic motor 6*c* is connected to the decelerator 6*e*, with these components being unitized. According to this construction, as described above, the detachable frame 10 can be detached from the rear frames 2*g*.

On the other hand, in the case where the winch drum, the decelerator and the hydraulic motor are connected in series and there is installed a winch capable of being divided between the winch drum and the reduction mechanism, the rear frames may each be provided with a mere winch opening of a circular shape without provision of the detachable frame.

In this case, winch components are installed inside the rear frames 2*g* from, for example, an opening above the rear frames and are then assembled through the openings S to constitute the winch.

In this embodiment, a gap is formed between each winch opening S and the winch 6. Of course, there may be adopted a modification in which an end portion of each rear frame 2*g* and the small-diameter portion of the winch are abutted against each other. In this case, the winch itself also functions as a strength enhancing member and therefore the rigidity can be enhanced to a greater extent. But also in this case the winch opening is set to satisfy the relation of $b>a\geqq c$.

There also may be adopted a construction wherein the mounting brackets 14*a* (see FIG. 4) are abutted against the cutout portions of the rear frames 2*g* and also against the side plates 10*a* of the detachable frame 10 to close the openings S. In this case, as is the case with the above, the winch can be allowed to function as a strength enhancing member. As a result, it is possible to enhance the rigidity to a greater extent.

Although in the above embodiment the winch drum is installed inside the rear frames 2*g*, this constitutes no limitation. For example, the clutch device, decelerator and motor as winch components may be installed inside the rear frames 2*g* and the winch drum may be disposed outside the rear frames.

Figure 6:
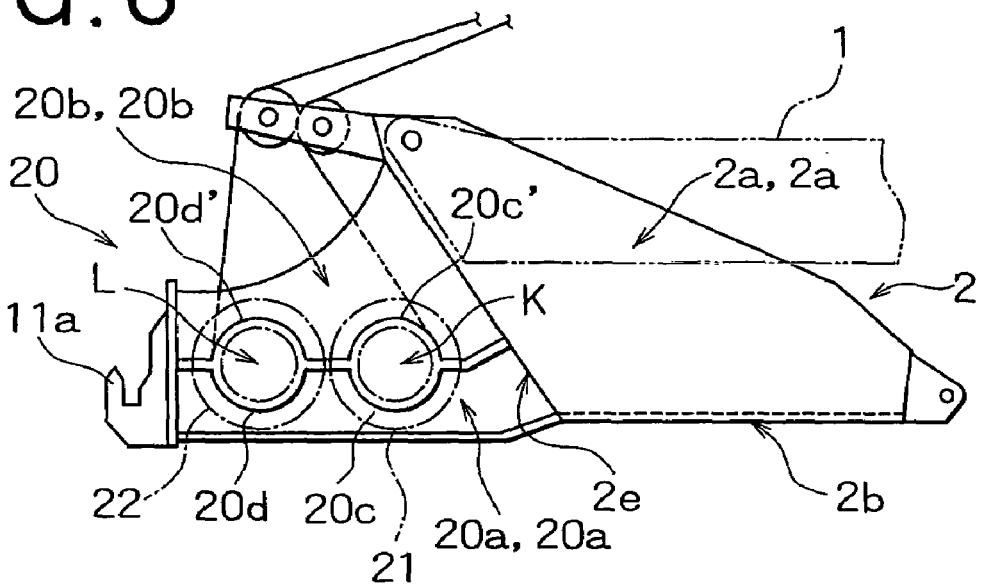
FIG. 6 is a side view of the rotating frame according to a second embodiment of the present invention.

FIG. 6 illustrates a second embodiment of the present invention, in which winches are disposed at front and rear positions of rear frames.

In this embodiment, rear frames 20 extend backward from rear ends 2*e* of a pair of boom support frames 2*a*. The rear frames (rear portions of the boom support frames) 20 are constituted by vertically combining a pair of lower rear frames 20*a* with a pair of upper rear frames 20*b* (only this-side ones of the lower and upper rear frames are shown, namely only each one of the frames shown on this paper is drawn).

Cutout portions 20*c* and 20*d* are formed semicircularly in each of the lower rear frames 20*a* and cutout portions 20*c*' and 20*d*' are also formed semicircularly in each of the upper rear frames 20*b*. The cutout portions 20*c* and 20*d* are respectively opposed to the cutout portions 20*c*' and 20*d*', and when these cutout portions are combined together, there are formed circular openings K and L.

A main winch 21 and an auxiliary winch 22 are disposed in the openings K and L, respectively.

The cutout portions 20*c* and 20*c*' are formed along an outer periphery surface (a small-diameter portion) of an accelerator of the main winch 21, while the cutout portions 20*d* and 20*d*' are formed along an outer periphery surface (a small-diameter portion) of an accelerator of the auxiliary winch 22. The lower rear frames 20*a* are connected detachably to the rear ends of the boom support frames 2*a* and also to the upper rear frames 20*b*.

According to this arrangement, even in the case of large-diameter winches difficult to be disposed coaxially in the transverse direction of the machine body and difficult to be disposed vertically, they can be disposed in the rear frames compactly.

The rear frames 20*a* and 20*b* are constituted detachably for the boom support frames 2*a*. Therefore, not only it is possible to remove the rear frames at the time of moving the crane, thereby shortening the overall length of the crane, but also it is possible to lighten the weight of the crane.

Figure 7:
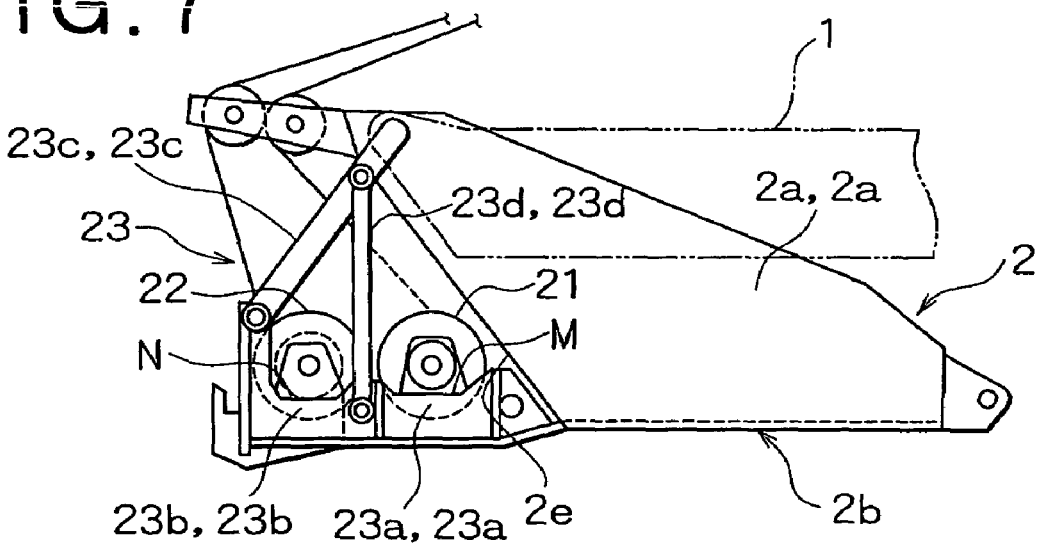
FIG. 7 is a side view of the rotating frame according to a third embodiment of the present invention.
Figure 8:
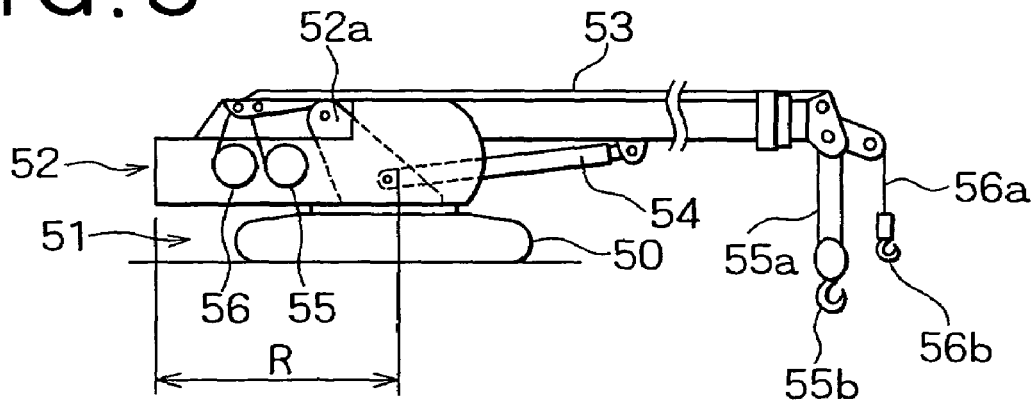
FIG. 8 is a side view of a travelling type crane.

FIG. 7 illustrates a third embodiment of the present invention, in which winches are disposed at front and rear positions of rear frames and the rear frames which support the winches are connected to a pair of boom support frames 2*a* through links.

In the same figure, rear frames 23 extend backward from the boom support frames 2*a*. The rear frames (rear portions of the boom support frames) 23 are mainly composed of a pair of rear frames 23*a*, another pair of rear frames 23*b* connected to and behind the rear frames 23*a*, (only this-side ones of these frames are shown), a pair of links 23*c* and a pair of links 23*d*, (only this-side ones of these links are shown), for connecting the rear frames to the boom support frames 2*a*.

A concave cutout portion M is formed in each rear frame 23*a* and a concave cutout portion N is also formed in each rear frame 23*b*. A main winch 21 and an auxiliary winch 22 are disposed in the cutout portions M and N, respectively.

The links 23*c* and 23*d* function to not only support rear and front portions of the rear frames 23*b* but also close upper-side openings of the cutout portions M and N.

The cutout portions M of the rear frames 23*a* are formed along a part of an outer periphery surface (a small-diameter portion) of a decelerator of the main winch 21, while the cutout portions N of the rear frames 23*b* are formed along a part of an outer periphery portion (small-diameter portion) of a decelerator of the auxiliary winch 22.

In this case, as in the previous second embodiment, even large-diameter winches difficult to be disposed coaxially in the transverse direction of the machine body and also difficult to be disposed vertically can be disposed compactly in the rear frames.

The rear frames 23*a* are connected detachably to the boom support frames 2*a*. The rear frames 23*b* are connected detachably to the rear frames 23*a*. Therefore, the main winch 21 and the auxiliary winch 22 can be disposed each independently in the rear frames.

It is preferable to adopt a construction wherein the rear frames 23*a* and 23*b* are connected through links 23*c* and 23*d* to the boom support frames 2*a*. This construction is advantageous in that even if a torsion is transmitted through the winches to the rear frames 23*a* and 23*b*, the torsion can be absorbed at the connections.

As shown in each of the above embodiments if the winch mounting portions at the rear portions of the boom support frames are constructed in a dividable manner through winch openings, it is possible to form openings which permit easy insertion and removal of the winches installed inside the frames. Consequently, the working efficiency in mounting the winches to the rear portions of the boom support frames can be improved remarkably.

Although in the above embodiments there are shown constructions wherein winch mounting portions can be divided in the longitudinal direction, there may be adopted a construction wherein winch mounting portions can be divided in the transverse direction, insofar as it is possible to span openings. It is also possible to adopt a construction wherein only a part of each side face is formed detachably. In the third embodiment shown in FIG. 7, winch drum flanges, when seen sideways, are installed inside while being enclosed with rear frames and links on the frames which are connected to the rear portions of the boom support frames. In this case, the motor and the decelerator are mounted sideways and outwardly projectingly from each winch drum.

The traveling working machine of the present invention is applicable not only to the telescopic boom type crane described in the above embodiments but also to a latticed boom type crane, an excavator, or a pile driver.

According to a basic construction of the present invention, as set forth above, in a traveling working machine wherein an upper rotating body having winches and a boom capable of rising and lowering is mounted on a lower traveling body, a pair of right and left boom support frames which pivotally support both right and left sides of rear ends of the boom are formed in a rotating frame of the upper rotating body, and the winches are supported while being mounted axially partially within rear portions of the boom support frames, the rear portions of the boom support frames are formed with openings as cutout portions along smaller-diameter portions than maximum-diameter portions of the winch portions mounted inside the frame rear portions.

With this construction, it is possible to improve the strength of the rotating frame to a greater extent and thereby strengthen the load bearing force.

In the present invention, the rear portions of the boom support frames may be constituted by fixed frames and detachable frames connected detachably to the fixed frames, and both such fixed and detachable frames are connected together to form the foregoing openings.

According to this construction, if the detachable frames are detached, even a winch whose overall length is larger than the rear frame width can be attached to the rear portion of the rotating frame in a simple manner.

It is preferable to adopt a construction wherein in a mutually connected state of both fixed and detachable frames, openings of a generally circular shape are formed along the outer peripheries of winches' small-diameter portions.

According to this construction it is possible to minimize the area of each opening and enhance the strength of the rear portions of the boom support frames effectively.

In the present invention, winches can be disposed vertically and also can be disposed longitudinally at the rear portions of the boom support frames.

In the vertical arrangement, since the strength of the rear portions of the boom support frames can be enhanced by the foregoing basic construction, it is possible to dispose winches vertically at the rear portions of the boom support frames and hence possible to shorten the rear end radius.

In the longitudinal arrangement, winches of a large diameter incapable of being disposed coaxially in the transverse direction of the machine body can be disposed at the rear portions of the boom support frames compactly.

Further, the boom support frames whose predetermined strength is ensured by the foregoing predetermined strength can be provided with counterweight mounting portions for mounting a counterweight.

The counterweight mounting portions can be formed at the rear ends of the boom support frames because the strength of the rear portions of the boom support frames is enhanced by the foregoing basic construction.

Although the invention has been described with reference to the preferred embodiments in the attached figures, it is noted that equivalents may be employed and substitutions made herein without from the scope of the invention as recited in the claims.

I claim:

1. A traveling working machine comprising:

a lower traveling body;

an upper rotating body mounted rotatably on said lower traveling body, said upper rotating body having a rotating frame and winches;

a boom mounted on said upper rotating body so as to be capable of rising and lowering; and a pair of right and left frames which support the boom formed in said rotating frame to pivotally support both right and left sides of a rear end portion of said boom, axial portions of the winches, including maximum-diameter portions of the winches, being mounted inside rear portions of said frames which support the boom, said frames which support the boom having recessed cut-outs along smaller-diameter portions of one of the winches than said maximum-diameter portions, said smaller-diameter portions not including shafts of said one of the winches, wherein the rear portions of said frames which support the boom at each side of the machine comprise a fixed frame and a detachable frame connected detachably to said fixed frame, and winch openings adapted to pass the smaller-diameter portions of said one of the winches are formed by the recessed cut-outs and the detachable frames when both said fixed and detachable frames are connected together so as to sandwich the smaller-diameter portions of said one of the winches with the detachable frames supporting said one of the winches from below.

2. A traveling working machine according to claim 1, wherein in a mutually connected state of both said fixed and detachable frames, said openings have a generally circular shape.

3. A traveling working machine according to claim 1, wherein said winches are mutually disposed vertically at the rear portions of said frames which support the boom.

4. A traveling working machine according to claim 1, wherein said winches are mutually disposed longitudinally at the rear portions of said frames which support the boom.

5. A traveling working machine comprising:

a lower traveling body;

an upper rotating body mounted rotatably on said lower traveling body, said upper rotating body having a rotating frame and winches;

a boom mounted on said upper rotating body so as to be capable of rising and lowering;

a pair of right and left frames which support the boom formed in said rotating frame to pivotally support both right and left sides of a rear end portion of said boom, axial portions of the winches, including maximum-diameter portions of the winches, being mounted inside rear portions of said frames which support the boom, said frames which support the boom having recessed cut-outs along smaller-diameter portions of the winches than said maximum-diameter portions said smaller-diameter portions not including shafts of the winches, wherein the rear portions of said frames which support the boom each comprises a fixed frame and a detachable frame connected detachably to said fixed frame, and winch openings adapted to pass the smaller-diameter portions of the winches are formed by the recessed cut-outs and the detachable frames when both said fixed and detachable frames are connected together so as to sandwich the smaller-diameter portions of the winches with the detachable frames supporting the winches from below, further comprising:

counterweight mounting portions for mounting a counterweight, said counterweight mounting portions being provided at the detachable frames of the rear portions of said boom support frames.

* * * * *